US010408205B2

(12) United States Patent
Sobin et al.

(10) Patent No.: US 10,408,205 B2
(45) Date of Patent: Sep. 10, 2019

(54) METHOD OF DETERMINING PUMP FILL AND ADJUSTING SPEED OF A ROD PUMPING SYSTEM

(71) Applicant: Schneider Electric USA, Inc., Andover, MA (US)

(72) Inventors: Zackery Sobin, Raleigh, NC (US); Scott Guimond, Gatineau (CA); James Redmond, Richmond (CA)

(73) Assignee: Schneider Electric Systems Canada Inc., Montreal, Quebec (CA)

( * ) Notice: Subject to any disclaimer, the term of this patent is extended or adjusted under 35 U.S.C. 154(b) by 405 days.

(21) Appl. No.: 15/228,747

(22) Filed: Aug. 4, 2016

(65) Prior Publication Data

US 2018/0038366 A1 Feb. 8, 2018

(51) Int. Cl.

| | |
|---|---|
| ***E21B 43/12*** | (2006.01) |
| ***E21B 47/00*** | (2012.01) |
| ***F04B 47/02*** | (2006.01) |
| ***F04B 49/06*** | (2006.01) |
| ***F04B 49/20*** | (2006.01) |
| ***F04B 53/14*** | (2006.01) |

(52) U.S. Cl.

CPC ..... *F04B 47/022* (2013.01); *E21B 43/127* (2013.01); *E21B 47/0008* (2013.01); *F04B 49/065* (2013.01); *F04B 49/20* (2013.01); *F04B 53/14* (2013.01); *F04B 2201/1202* (2013.01); *F04B 2201/1211* (2013.01)

(58) Field of Classification Search

CPC ..... F04B 47/022; F04B 49/065; F04B 2201/1202; F04B 49/20; F04B 2201/1211; E21B 43/127; E21B 47/0008

See application file for complete search history.

(56) References Cited

U.S. PATENT DOCUMENTS 2,691,300 A 10/1954 Morris
4,490,094 A * 12/1984 Gibbs ..... F04B 47/02 417/42

(Continued)

*Primary Examiner* — Christopher S Bobish
(74) *Attorney, Agent, or Firm* — Locke Lord LLP

(57) ABSTRACT

A method and system for determining the pump fillage of a sucker rod pumping system using torque feedback when pumping wellbore fluids from the particular well on which the sucker rod pumping system is installed. During the pump stroke, a microprocessor samples torque of the pump's mechanical system at an associated horsehead position at regular intervals and once the stroke is completed the raw torque samples and associated horsehead positions are placed in an array, the array of raw torque samples and horsehead positions can be filtered by the microprocessor into a second filtered array and then converted by the microprocessor into a rotatum array (derivative of torque with respect to time) of one or both of the raw or filtered arrays and stored as a rotatum array. The down stroke portion of the rotatum array is then analyzed by the microprocessor to determine the horsehead position when the piston of the down hole pump encounters wellbore fluid in the well (pump fillage). The microprocessor, based on the determined pump fillage, adjusts the speed of the pumping system to maintain an optimal pump fillage determined to be the most economical for the particular well on which the sucker rod pumping system is installed.

19 Claims, 9 Drawing Sheets

(56) References Cited

U.S. PATENT DOCUMENTS

| | | | | |
|---|---|---|---|---|
| 7,558,699 | B2 | 7/2009 | Beck et al. | |
| 7,891,237 | B2 * | 2/2011 | Mills | E21B 47/0008 73/152.61 |
| 8,322,995 | B2 * | 12/2012 | Ehimeakhe | E21B 43/127 417/53 |
| 8,328,527 | B2 * | 12/2012 | Ehimeakhe | E21B 47/0008 417/53 |
| 8,793,080 | B1 * | 7/2014 | Erlandsson | G01L 5/108 702/189 |
| 8,892,372 | B2 | 11/2014 | Peterson | |
| 8,910,710 | B2 * | 12/2014 | Krauss | E21B 47/0008 166/250.15 |
| 2011/0103974 | A1 * | 5/2011 | Lamascus | F04B 47/02 417/45 |
| 2012/0251335 | A1 * | 10/2012 | Hurst | E21B 43/121 417/45 |
| 2014/0088875 | A1 | 3/2014 | Krauss | |
| 2014/0129037 | A1 | 5/2014 | Peterson | |
| 2015/0275651 | A1 * | 10/2015 | Chen | E21B 47/0008 702/6 |
| 2015/0345280 | A1 * | 12/2015 | Krauss | E21B 43/127 700/282 |
| 2016/0265321 | A1 * | 9/2016 | Elmer | E21B 47/0008 |
| 2017/0016313 | A1 * | 1/2017 | Pons | G05B 19/042 |
| 2017/0037845 | A1 * | 2/2017 | Al Assad | F04B 49/20 |
| 2017/0167482 | A1 * | 6/2017 | Assad | E21B 47/0008 |

* cited by examiner

METHOD OF DETERMINING PUMP FILL AND ADJUSTING SPEED OF A ROD PUMPING SYSTEM

FIELD OF THE INVENTION

The invention is generally directed to hydraulic lifting system and particularly to controlling the speed of a sucker rod pumping system.

BACKGROUND OF THE INVENTION

A pumping system is typically used to lift oil and other wellbore fluids from a subterranean reservoir to the surface. One commonly used pumping system is known as a "sucker rod" pump. A sucker rod pumping system incorporates a downhole reciprocating pump comprised of a reciprocating piston inside a pump barrel that is attached to a production tube. The barrel is located in a subterranean reservoir which is at least partially filled with the well bore fluids. The piston is linked to a prime mover at the surface by a mechanical system that translates the rotational movement provided by the prime mover to the reciprocal movement required for the pump piston. The mechanical mechanism includes a rod string, a polished rod, a bridle, a horsehead, a pivotally supported walking beam and a rotating arm. The rod string is connected to the piston and runs inside the production tube through which the wellbore fluids in the subterranean reservoir are lifted to the surface. The rod string is connected to the polished rod at the surface end of the production tube and the polished rod is attached to the bridle which is coupled to the horse head. The horse head is attached to one end of the walking beam and translates its pivotal movement to the reciprocal movement required for the piston. The rotating arm is connected between the other end of the walking beam and the prime mover. The downward stroke starts at the highest point of the horsehead and continues until the horsehead has reached its lowest point. During the down stroke the rod string and piston in the downhole reciprocating pump descend as gravity pulls them downward. The upstroke is powered by the prime mover, which lifts the rod string and piston upward until the horsehead has reached its highest point again.

As the piston descends on the down stroke a check valve (sometimes called the delivery valve or traveling valve) in the piston opens to let wellbore fluids in the barrel pass though. At the same time a check valve (sometimes called the inlet valve or standing valve) in the barrel closes to prevent wellbore fluids in the barrel from escaping into the subterranean reservoir surrounding the barrel. As the piston is raised on the up stroke the delivery valve is closed such that wellbore fluids that are above the piston are lifted upward into the production tube and towards the surface. At the same time the piston is being raised on the up stroke the inlet valve in the barrel opens permitting wellbore fluids in the subterranean reservoir surrounding the barrel to be sucked into the barrel. The cycle described here repeats during each complete stroke of the sucker-rod pumping system.

To operate a sucker-rod pump in a cost effective manner, the pump fillage level and speed of the stroke should be set such that a profitable amount of wellbore fluid can be extracted by the pumping system while avoiding conditions where the well is pumped off. A pump off condition occurs when the rate at which the subterranean reservoir is supplying wellbore fluids to the barrel is exceeded by the rate at which wellbore fluids are being pumped to the surface.

When a well is operating in a pumped off condition it is not operating in an effective and efficient manner. If the well is allowed to continue operating in a pump-off condition damage to the rod string and the downhole reciprocating pump will most likely occur. Any damage to the rod string or downhole reciprocating pump will result in down time for the well and expensive repairs to the damaged components. Therefore, an accurate means for determining the wellbore fluid level, pump fillage and adjusting the speed of the pumping system to maintain a cost effective operating level is desirable.

SUMMARY OF THE INVENTION

The present invention determines an optimal speed for a sucker rod pump by monitoring the torque of the prime mover providing motive force to the pump system. Since gearbox input torque, and crankarm torque are proportional to the prime mover torque, these torque values could also be used to provide similar results. The torque values are processed by a microprocessor according to an algorithm stored in a memory associated with the microprocessor. The results of the processing provide an accurate indication of pump fill which is then used by the microprocessor to adjust the pump an optimal speed for maintaining a cost effective operation of the pumping system.

The microprocessor performs the following operation according to the algorithm stored in the associate memory:

- recording at regular intervals during at least a down stroke portion of an entire pump stroke, a raw torque value of a mechanical linkage of the rod pump with respect to a particular position of a horsehead of the rod pump at each recording interval;
- storing, in a non-transitory memory associated with a microprocessor, the recorded raw torque with respect to the particular position of the horsehead as a raw torque array;
- creating, by the processor, from the raw torque array a filtered torque array and storing the filtered torque array in the memory;
- creating, by the processor, from the filtered torque array a rotatum array and storing the rotatum array in the memory;
- determining, by the microprocessor, a pump fillage of the rod pump from the rotatum array, and;
- adjusting, by the microprocessor, a speed of the prime mover based on the determined pump fillage.

DETAILED DESCRIPTION OF THE EMBODIMENTS

Figure 1:
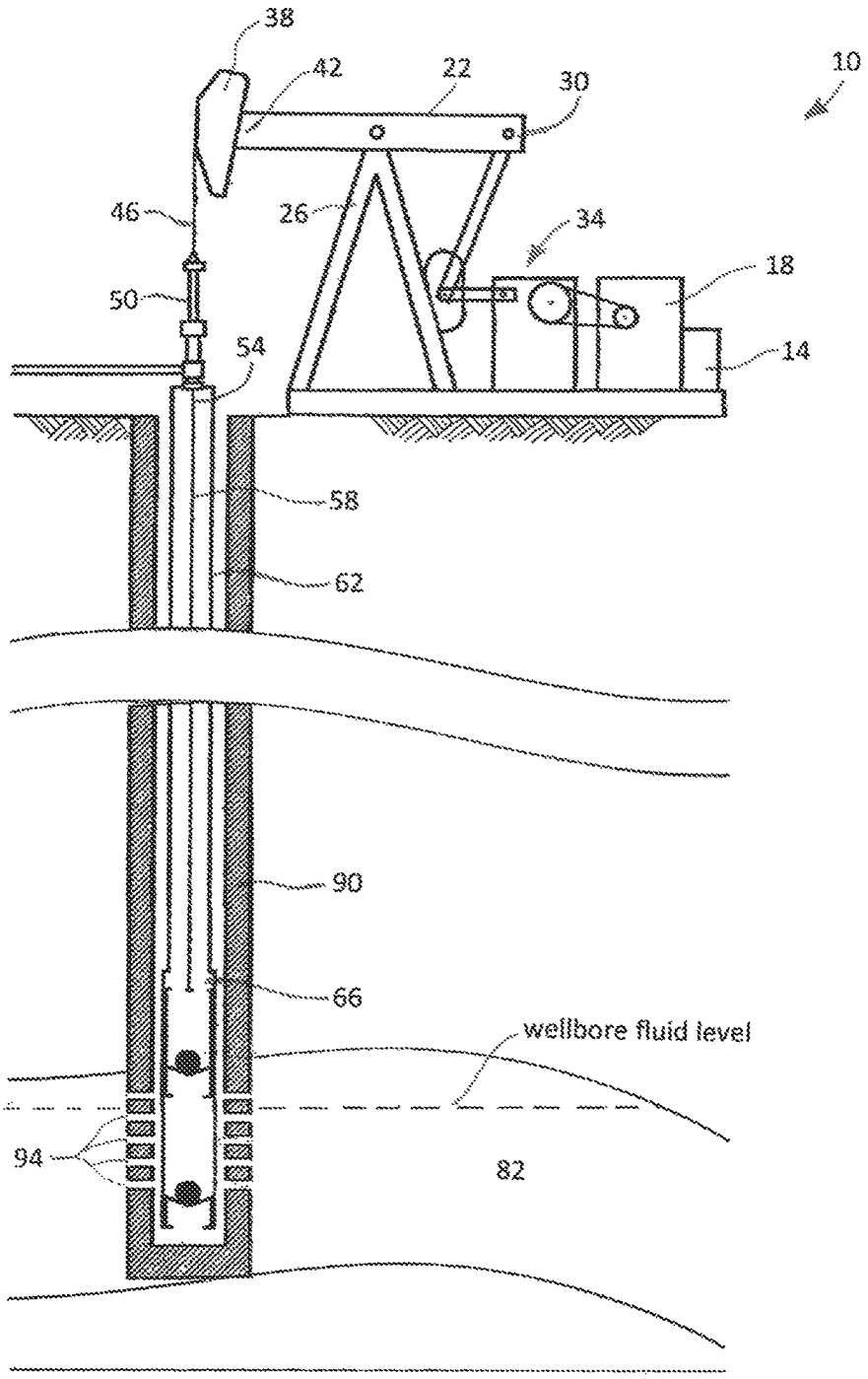
FIG. 1 illustrates a typical conventional sucker-rod pumping system.
Figures 2, 3:
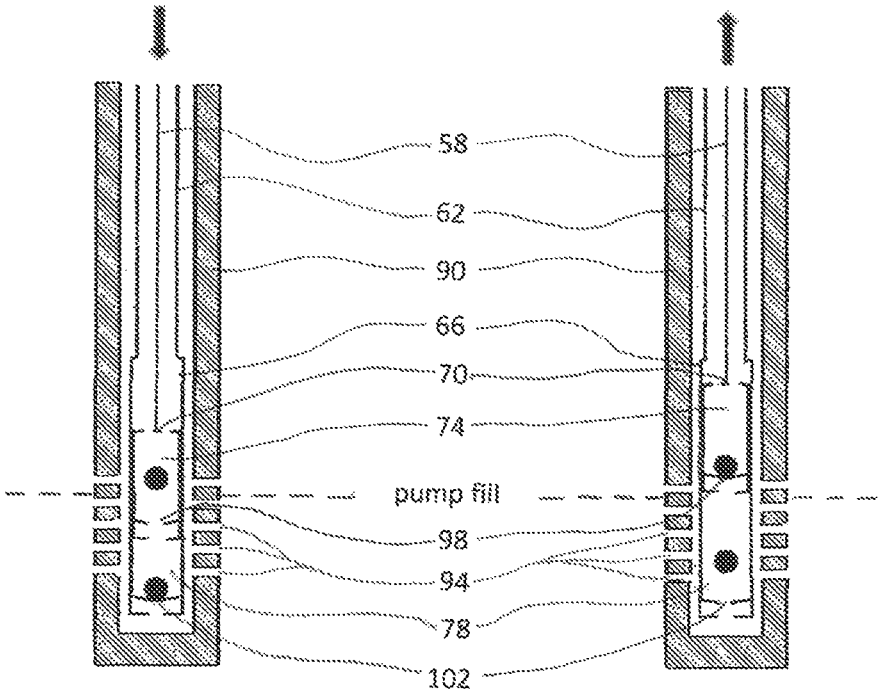
FIG. 2 illustrates a typical down hole pump on the down stroke.
FIG. 3 illustrates a typical down hole pump on the down stroke.

The present invention provides a method for accurately determining pump fill and adjusting pump speed to an optimum level for conventional or air balanced sucker rod pump using the API Spec. 11E geometry (also known as Rear-mounted geometry and Class I lever systems with crank counterbalance) and Mark II pumps that use the API Spec. 11E standard geometry (also known as a Front-mounted geometry and Class III lever systems with crank counterbalance). Referring to FIG. 1, a typical sucker rod pump system 10 is shown. The sucker rod pump system 10 includes a prime mover 14, which provides motive force to the pump system 10 as directed by a pump system controller 18. A walking beam 22 is pivotally supported on a jack post 26 and movably connected at a first end 30 to the prime mover 14 through a mechanical linkage 34, which can include rotating gears, wheels, a crankarm and a counterweight that translate a circular movement of the prime mover 14 into a generally reciprocal movement. A horsehead 38 is attached to the second end 42 of the walking beam 22. A bridle 46 is attached at one end to the horsehead 38 and at the other end to a polished rod 50. The horsehead 38 and bridle 46 translate the pivotal movement of the walking beam 22 into a reciprocating movement of the polished rod 50. The polished rod 50 is connected to a first end 54 of a rod string 58, which extends downward through a well production tube 62 into a downhole pump 66 (more clearly illustrated in FIGS. 2 and 3) where its second end 70 is attached to a piston 74 that reciprocates inside a pump barrel 78 of the downhole pump 66. The downhole pump 66 is located in a subterranean reservoir 82 where it is surrounded by well bore fluids 86. A well casing 90 surrounds the well production tube 62 and has a number of ports 94 that permit the well bore fluids 86 to pass through the well casing 90 and into the downhole pump 66.

During one complete stroke of the pumping system 10 the horsehead 38 falls from its highest position to its lowest position and returns to its highest position. As the horsehead 38 falls to its lowest position (FIG. 2) the piston 74 also falls to its lowest position in the pump barrel 78. As the piston 74 begins to fall a delivery or traveling valve 98 in the piston 74 is forced to open due to pressure exerted by well bore fluid 86 in the pump barrel 78. The opened delivery valve 98 allows the well bore fluids 86 in the pump barrel 78 to pass through the delivery valve 98. At the same time, an inlet or standing valve 102 in the pump barrel 78 is forced to close by pressure exerted on the well bore fluids 86 in the pump barrel 78 as the piston 74 falls to its lowest position. The closed inlet valve 102 prevents well bore fluids 86 in the pump barrel 78 from escaping into the subterranean reservoir 82. As the horsehead 38 is raise to its highest position by the prime mover 14 (FIG. 3) the delivery valve 98 in piston 74 is forced to close by pressure exerted on the delivery valve 98 by well bore fluids 86 that have passed through the delivery valve 98 during the down stroke. The rising piston 74 causes a negative pressure in the pump barrel 78, which opens the inlet valve 102 and permits well bore fluids 86 from the subterranean reservoir 82 to be sucked into the pump barrel 78. The rising piston 74 also forces well bore fluids 86 in the production tube 62 above piston 74 to the surface where they exit the production tube 62 through an exit tube 106. The delivery valve 98 and inlet valve 102 can be any type of valve that is capable of opening and closing as fluid pressure is exerted on the valve.

To operate a sucker rod pumping system 10 described above in an efficient manner the speed at which the pumping system 10 operates must be controlled such that the maximum amount of well bore fluids 86 are delivered to the exit tube 106 at the end of each upward stroke without lowering the level of well bore fluids 86 in the subterranean reservoir 82 to a point at which a pump-off condition results.

Figure 4:
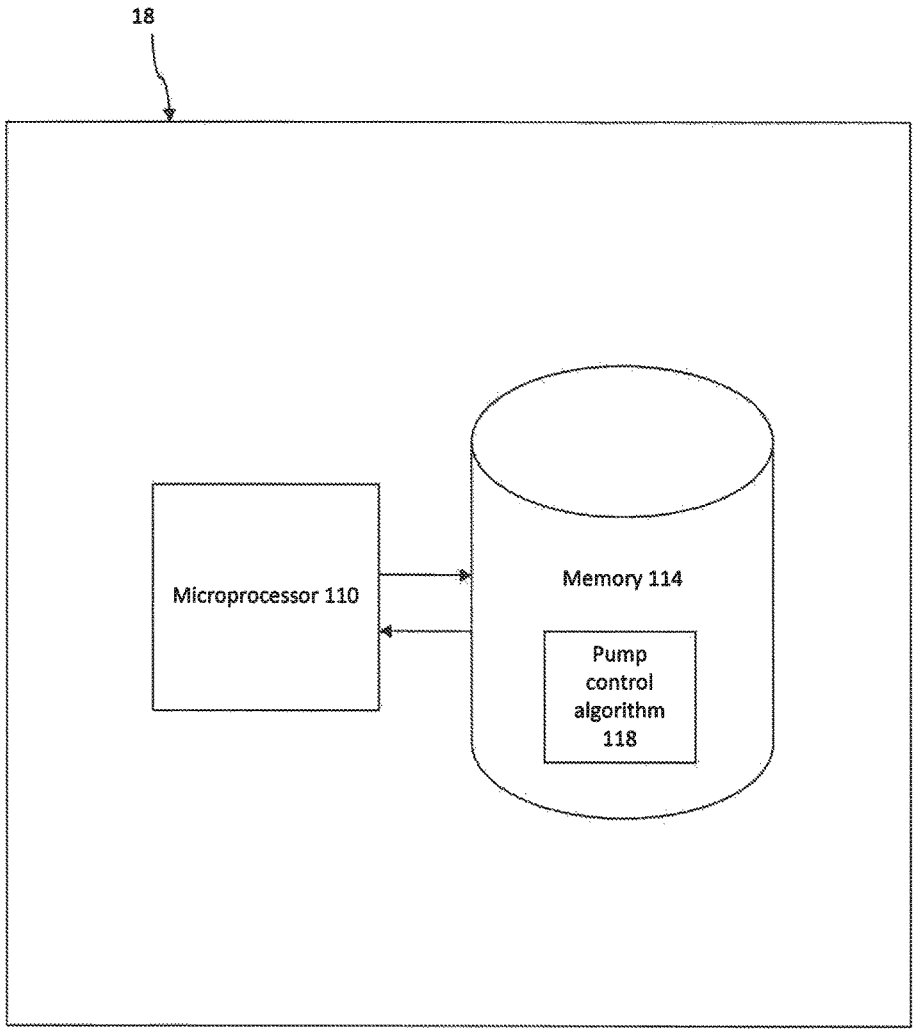
FIG. 4 illustrates a pump control system.
Figure 5:
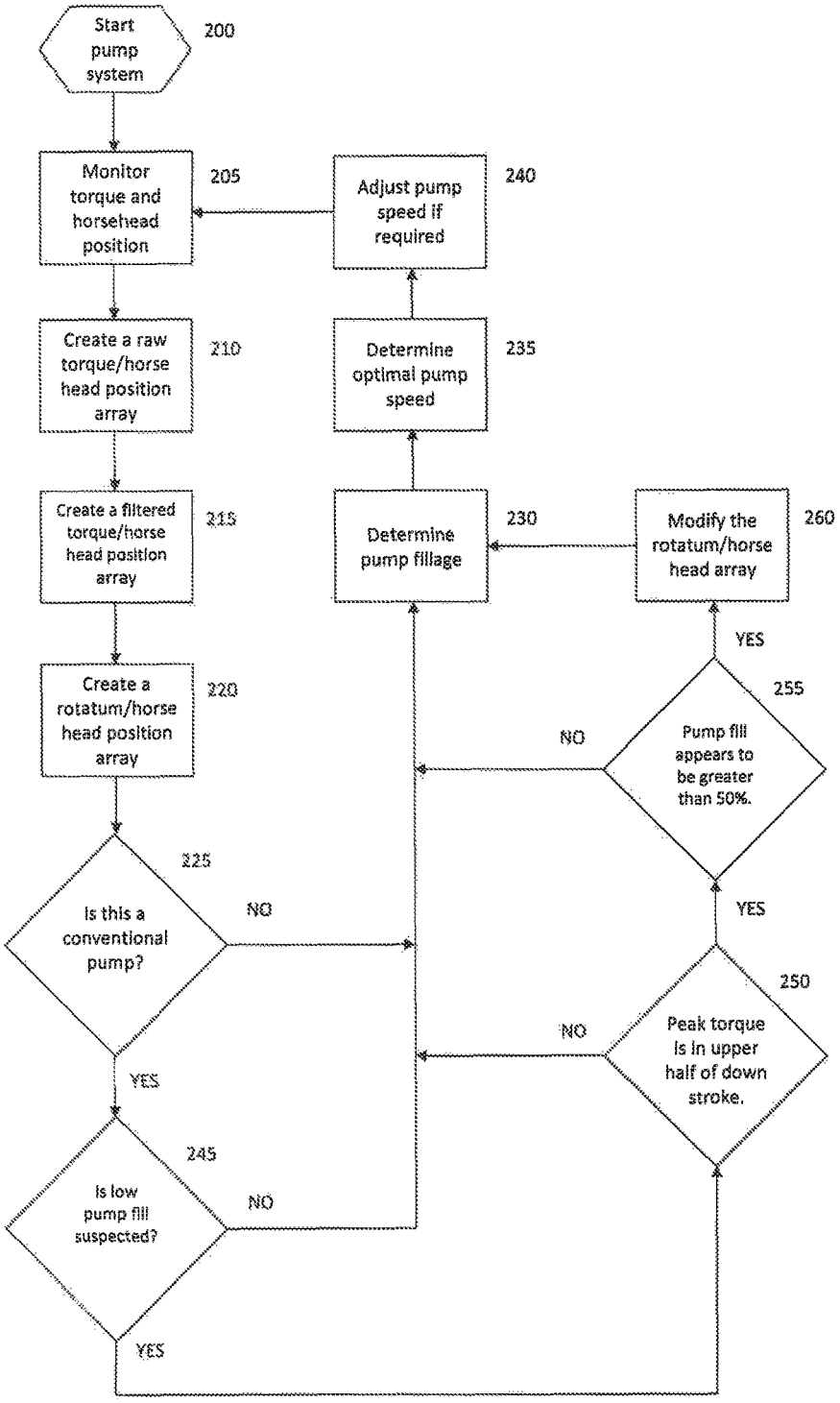
FIG. 5 is a flow chart of the speed control algorithm.

Referring now to FIG. 4, the pump system controller 18 includes a microprocessor 110, a non-transitory computer-readable memory 114, and a computer executable pump control algorithm 118 stored in memory 114, and configured to be executed by microprocessor 110. The pump control algorithm 118 of the present invention, as shown in the flow chart of FIG. 5, defines the steps to be performed by microprocessor 110 in determining pump fill and optimal pump speed from prime mover 14 torque with respect to a particular horsehead 38 position during a pump stoke.

At step 200 the microprocessor 110 initiates the pump control algorithm 118 as the pumping system 10 begins a pump stroke. At step 205 the pumping system 10 begins to monitor, at predetermined regular intervals, raw torque of the prime mover 14 with respect to a particular horsehead 38 position. Raw torque can also be monitored at several points in the mechanical linkage 34, however, the prime mover 14 provides the easiest point for monitoring and will be indicated as the torque monitoring point in the example discussed herein. The number of intervals monitored should be sufficient to produce a graphical representation of the pump stroke that appears smooth to the naked eye and is limited only by the technology used. It is also understood that at any time during the disclosed process the number of intervals can be downsampled or filtered by any known means such as averaging, moving average, interpolating, removing outlying torque samples, decimation, low-pass, exponentially weighted moving average (EWMA), finite or infinite impulse response, or frequency domain filtering, etc. to make the calculations more manageable and to make the graphic representation of the array smoother. The torque of prime mover 14 can be measured or determined by using a torque sensor, calculated by the system controller 18 or estimated from ammeter or power meter measurements.

At step 210 microprocessor 110 stores the monitored prime mover 14 raw torque and associated horsehead 38 positions of a complete pump stroke in memory 114 as a raw torque array Traw, as shown below where N is the number of intervals monitored.

$$T(\text{raw})=[T(\text{raw}0),T(\text{raw}1),T(\text{raw}2),\ldots T(\text{raw}N)]$$

Figure 6:
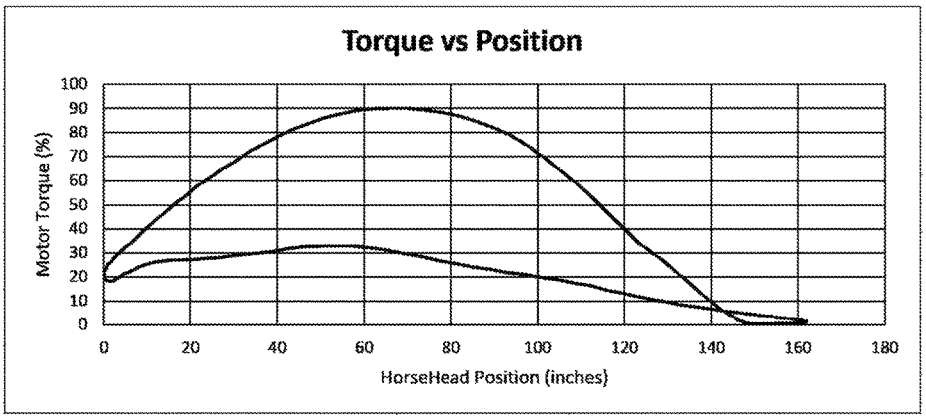
FIG. 6 a typical graph of raw torque vs horsehead position for one complete stroke of a conventional sucker-rod pumpjack.

FIG. 6 illustrates graphically the raw torque array Traw for one complete stroke.

At step 215 microprocessor 110 creates a filtered torque array Tf from the raw torque array (Traw) and stores the filtered torque array Tf in memory 114. As indicated above, downsampling or filtering can be done by any know means, for example a moving average as indicated below.

$$Tf=(T(n)=T(n-1)+T(n-2))/3$$

Figure 7:
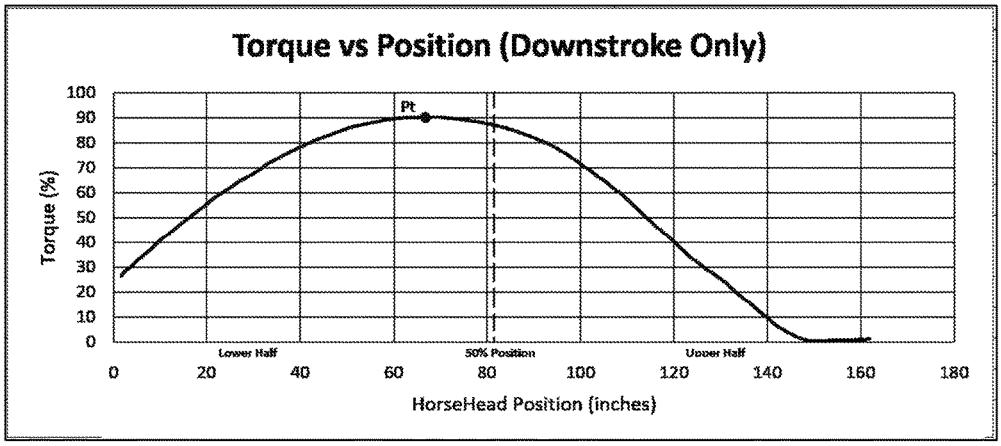
FIG. 7 is a graph of the filtered torque vs horsehead position for the down stroke portion of a conventional pumpjack.

FIG. 7 illustrates graphically the filtered torque array Tf of the down stroke.

Figure 8:
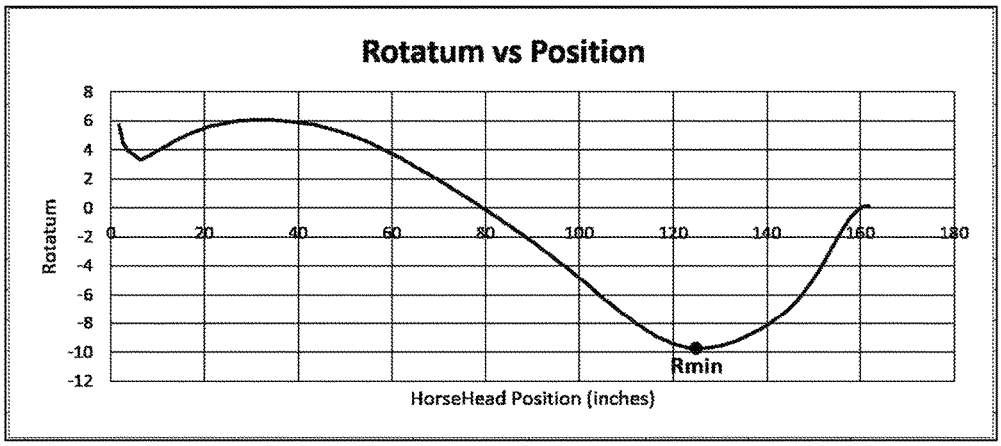
FIG. 8 is a graph of the rotatum vs horsehead position for the down stroke portion of a conventional pumpjack FIG. 9 a typical graph of raw torque vs horsehead position for one complete stroke of a non-conventional (Mark II) sucker-rod pumpjack.

At step 220 microprocessor 110 creates a rotatum array R of the down stroke from the filtered torque array Tf, shown in FIG. 7, and stores the rotatum array R in memory 114. FIG. 8 illustrates graphically the down stroke rotatum array R derived from the formula below.

$$R(n)=[(Tf(n)-Tf(n+B))]$$

The value of B can be selected by examining torque data from any well, or collection of wells. The selected value of B should accentuate the effects of pump fill in the generated rotatum array R. Torque curves, and downhole cards from one or more wells, can be compared with rotatum arrays from the same wells to see if there was a strong correlation between pumpfill as shown by the rotatum minimum and pump-fill as shown by the torque curve or downhole card.

When the piston 74 of the down hole pump 66 encounters the well bore fluids 86 there will be a change in prime mover 14 torque. The magnitude of torque change and span of horsehead position over which these changes occur determines the range for value of B such that:

1. The minimum value of B is limited because Tf(n+B) must be spaced far enough apart in time from Tf(n) so that when viewing the resulting rotatum curve or scanning of the rotatum array R by the microprocessor 110, there will be a detectable difference in torque value between them at the point when the piston 74 encounters the well bore fluids 86. B must be greater than 1 because the closest sample to compare is the adjacent sample.
2. The maximum value of B is limited because Tf(n+B) must be spaced close enough in time to Tf(n) so that there will not be a greater difference in torque between them than could be caused by things (such as differences in mechanical advantage of the crankarm to the linear motion of the bridle at different points in the stroke, or changes in counterweight balance position) other than the piston 74 encountering the well bore fluids 86. To reduce the effects of the above phenomena, the torque samples being compared should generally be less than 25% of the downstroke apart from each other.
3. The value of B that best accentuates the effects of pump fill in the rotatum curve is selected from values between the maximum and the minimum of Tf(n+B).

In some instances a non-integer value of B is selected to best accentuate the effects of pump fill in the generated rotatum array R, the value of torque at (n+B) can be estimated by using linear interpolation between points (n+A) and (n+C). The following formula is used to determine the portions of point (n+A) and (n+C) required to produce the non-integer (n+B).

$$R(n)=[a*(Tf(n)-Tf(n+A))+c*(Tf(n)-Tf(n+C))]$$

As an example, in a pumpjack where 128 samples per stroke were stored, comparison between points that are 1.2 samples apart was selected for (n+B) based on the description provided above for comparing pumpfill as shown by the rotatum minimum and pump-fill as shown by the torque curve or downhole card and determining the minimum and maximum values for (n+B).

The following chart shows values that can be used in the formula for the example above.

| Parameter | Value | Basis for Selection |
|---|---|---|
| B | 1.2 | Desired number of points between torque values to be compared.<br>This value falls within the range specified above.<br>Calculated from parameter B above |
| A | 1 | Closest integer smaller than B |
| C | 2 | Closest integer larger than B |
| a | 0.8 | Weighting value for comparison to (n + A)<br>a = A − B + 1 |
| c | 0.2 | Weighting value for comparison to (n + C)<br>c = C − B − 1 |

At step 225, microprocessor 110 determines whether the pump is a conventional pump or a Mark II pump. Information relating to whether the pump is conventional or not conventional (Mark II) is usually provided by well management personnel during commissioning of the pumping system 10 and stored in memory 114. If it is determined at step 225 that the pump is not conventional the microprocessor will proceed to step 230, which will be discussed in detail later. If it is determined at step 225 that the pump is conventional the microprocessor will proceed to step 245.

Figure 11:
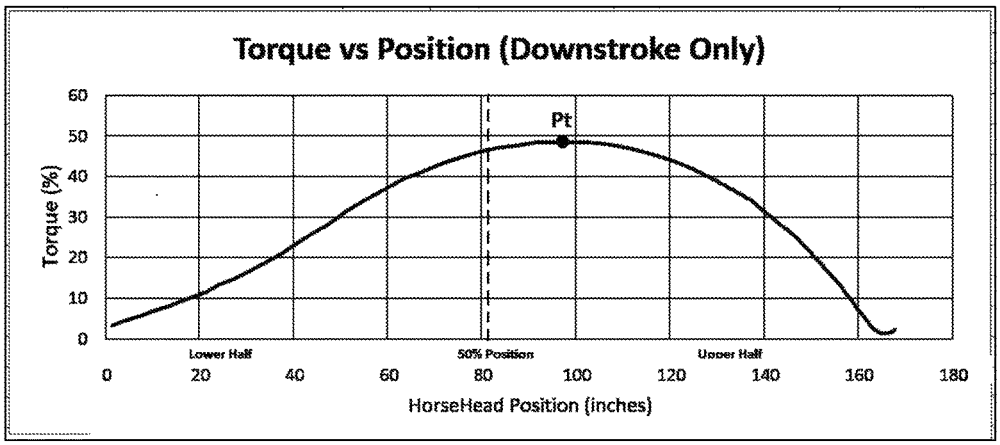
FIG. 11 is a graph of torque vs horsehead position for the down stroke portion of a conventional pumpjack in a low producing well.
Figure 12:
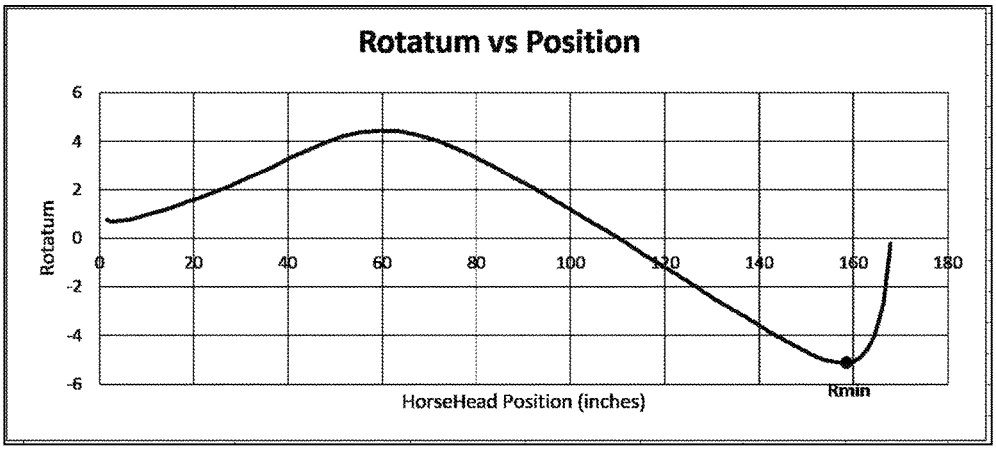
FIG. 12 is a graph illustrating the rotatum vs horsehead position for the down stroke portion of a conventional pumpjack on a low producing well.

At step 245 the microprocessor 110 will determine if the well is suspected of having low pump fill and therefore a low producing well. Information indicating that a well is known to have the possibility of low pump fill is stored in a flag. This flag can be set at well commissioning or any time it is learned or suspected that the well has a possibility of having low pump fill. This flag is stored in memory 114 for use at step 245. The flag can be set by the well manager, operator or microprocessor 110 after determining that the pumpfill trend from one stroke to the next is decreasing consistently and trending in a way that suggest true pumpfill will drop below 50%. Other indicators such as the peak raw torque being in the upper half of the down stroke, as shown in FIG. 11, and pump fill indicated as greater than 50% in the upper half of the down stroke, as shown in FIG. 12, can also indicate a possible low pump fill condition. At step 245 the microprocessor 110 can scan the torque vs horsehead 38 position array of FIG. 11 and the rotatum array R of FIG. 12 to determine if these indicators are present. If it is determined by the microprocessor 110 at step 245 that the well is not a low producing well the microprocessor 110 will proceed to step 230. If the microprocessor 110 determines that a flag has been set in the pump control algorithm 118 indicating a suspected low pump fill or detects indicators of low pump fill the microprocessor 110 will proceed to step 250, which will be discussed in detail later.

At step 230 the microprocessor 110 determines pump fillage. In a conventional well this is accomplished by scanning the down stroke portion of the rotatum array R for a rotatum minimum Rmin and a maximum horsehead 38 position, as shown in FIG. 8.

In a conventional well the pump fill is determined by dividing the horsehead 38 position associated with the rotatum minimum Rmin by the maximum horsehead 38 position. In FIG. 8 the horsehead 38 position associated with the rotatum minimum Rmin is approximately 125 inches and the maximum horsehead 38 position B is approximately 162 inches, resulting in a pumpfill of approximately 77%.

$$\text{Pumpfill}\,\% = \frac{\text{Horsehead position @ } (R\text{min})}{\text{Maximum Horsehead position}} \times 100$$

Figure 9:
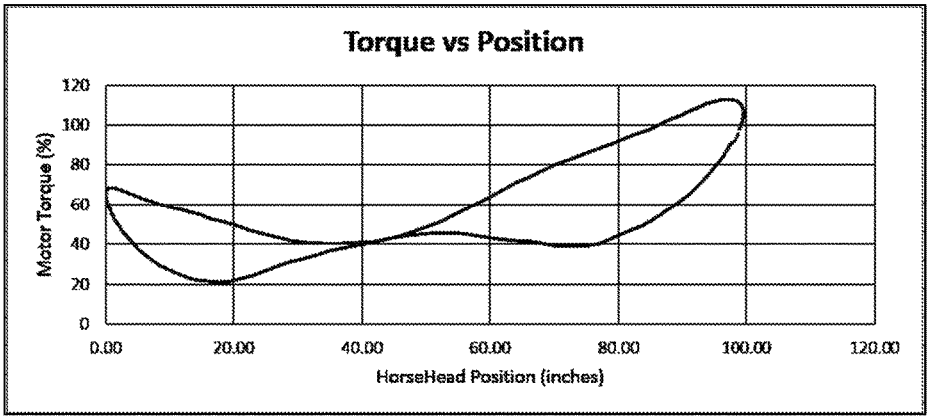
Figure 10:
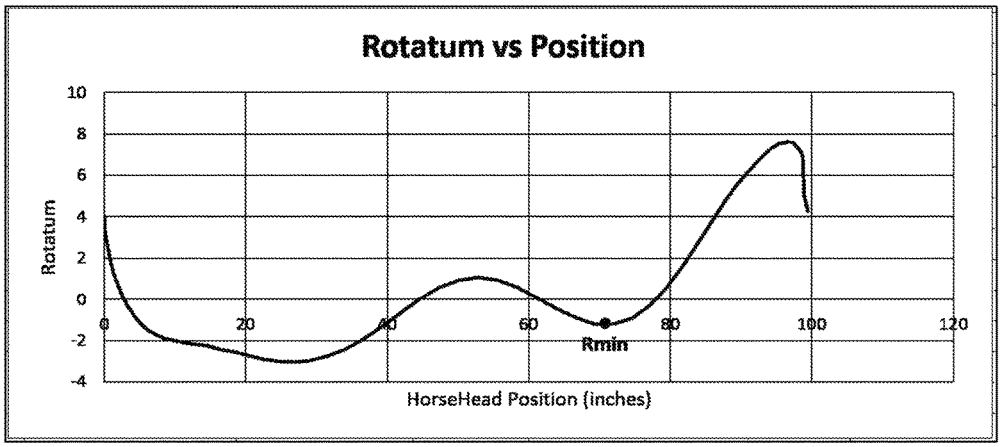
FIG. 10 is a graph of rotatum vs horsehead position for the down stroke portion of a non-conventional pumpjack

Prime mover 14 torque is applied slightly different in a non-conventional Mark II pump and therefore the graphical representation of the array TrawMII for a full pump stroke is different, as shown in FIG. 9. For non-conventional wells microprocessor 110 determines pump fillage by scanning the down stroke portion of the rotatum array R, which is different from a conventional pump, for the highest rotatum minimum Rmin position, as shown in FIG. 10. The horsehead 38 position that corresponds to this Rotatum minimum Rmin is used with the maximum horsehead 38 position to calculate pump fill using the same formula as shown above for a conventional pump At step 235 the microprocessor 110 determines the optimal pump system 10 speed from the determined pump fill by comparing the determined pump fillage with a previously determined target pump fillage. The difference between the target pump fillage and the determined pump fillage is the fill error. The pump speed is adjusted to eliminate or reduce the fill error. To prevent extreme speed changes, the speed will be increased or decreased by no more than a predetermined percentage at each pump speed change.

Steps 250 through 260 are for conventional pumps that are operating on wells that have been suspected of being low producing wells in step 245. Steps 250 and 255 provide a more accurate determination that the well is truly a low producing well and step 260 provides a more accurate determination of the pump fillage position in a low producing well.

At step 250 the microprocessor 110 determines whether the peak torque Pt as indicated in FIG. 11, which is a graphic representation of a torque vs horsehead 38 position for the down stroke portion of a conventional pumpjack on a low producing well, is in the upper or lower half of the down stroke. If the peak torque Pt is in the lower half of the down stroke, as shown in FIG. 7, the microprocessor 110 proceeds to step 230 for determining pump fillage. If the peak torque Pt is in the upper half of the down stroke, as shown in FIG. 12, the microprocessor 110 proceeds to step 255.

At step 255 the microprocessor 110, using the rotatum minimum Rmin of FIG. 12, will determine if the pump fillage appears to be greater than 50%. This determination is made by using the formula indicated above in step 230. If the pump fillage does not appear to be greater than 50% the microprocessor 110 proceeds to step 230 for determining pump fillage. If the pump fillage does appear to be greater than 50%, as it is in FIG. 12 (horsehead 38 position of approximately 160 at the rotatum minimum Rmin divided by maximum horsehead 38 position B, approximately 167 and multiplied by 100, giving an erroneous pump fillage of approximately 95%), the microprocessor 110 proceeds to step 260.

Figure 13:
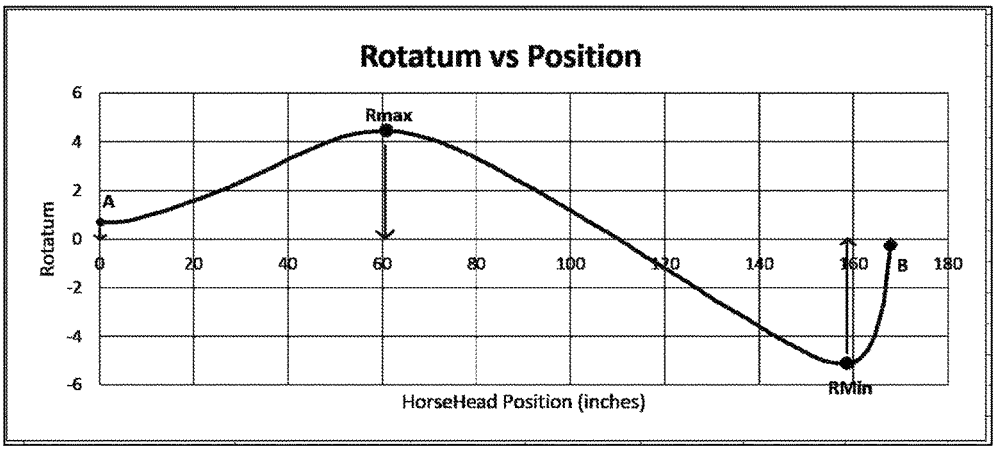
FIG. 13 is a graph illustrating the modifications to the rotatum vs horsehead position array of FIG. 12 for determining pump fill of a low producing well.
Figure 14:
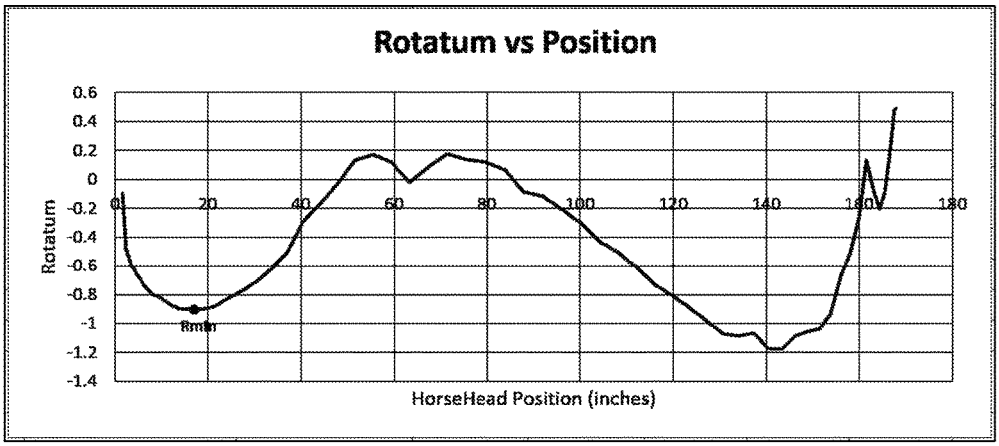
FIG. 14 is a graph of the modified rotatum vs horsehead position for the down stroke portion of a conventional pumpjack on a low producing well.

At step 260, microprocessor 110 will modify the rotatum vs horsehead 38 position array R of FIG. 12 by dragging the minimum horsehead 38 position A, the maximum horsehead 38 position B, the rotatum minimum Rmin and rotatum maximum Rmax position to the rotatum zero line, as shown in FIG. 13. This resulting modified rotatum array Rm, graphically shown in FIG. 14, is used by microprocessor 110 to accurately determine the pump fillage in a low producing well. The microprocessor 110 scans the modified rotatum array Rm from the minimum horsehead 38 position A to find the first rotatum minimum FRmin as shown in FIG. 14. Microprocessor 110 then proceeds to step 230 where the horsehead 38 position associated with the first rotatum minimum FRmin will be used to accurately determine pump fillage at step 230.

We claim:

1. A method for determining an optimal speed for a sucker rod pump comprising:

recording at regular intervals during at least a down stroke portion of an entire pump stroke, a raw torque value of a mechanical linkage of the rod pump with respect to a particular position of a horsehead of the rod pump at each recording interval;

storing, in a non-transitory memory associated with a microprocessor, the recorded raw torque with respect to the particular position of the horsehead as a raw torque array;

creating, by the processor, from the raw torque array a filtered torque array and storing the filtered torque array in the memory;

creating, by the processor, from the filtered torque array a rotatum array and storing the rotatum array in the memory;

determining, by the processor, a pump fillage of the rod pump from the rotatum array, wherein the determining includes one of:

for a conventional pump, scanning the rotatum array from a highest horsehead position to a lowest horsehead position and determining a rotatum minimum and a maximum horsehead position, and dividing a horsehead position associated with the rotatum minimum by the highest horsehead position and multiplying by 100; or for a non-conventional pump, scanning the rotatum array from a lowest horsehead position to a highest horsehead position and determining a highest rotatum minimum and a maximum horsehead position, and dividing a horsehead position associated with the rotatum minimum by the highest horsehead position and multiplying by 100; and adjusting, by the processor, a speed of a prime mover configured to drive the rod pump, based on the determined pump fillage.

2. The method of claim 1, wherein the raw torque is measured at one of several points in the mechanical linkage of the rod pump comprising:

a prime mover providing motive force to the rod pump;

a gearbox input; or a crankarm.

3. The method of claim 1, wherein determining the raw torque value is accomplished by any one of:

measuring with a torque sensor;

measuring with a variable speed drive;

or estimating from measurements of an ammeter and/or a power meter.

4. The method of claim 1, wherein creating the rotatum array is accomplished by taking a derivative of the filtered torque array.

5. The method of claim 1, wherein creating the filtered torque array is accomplished by filtering the raw torque array using any one of:

averaging;

a moving average;

interpolating;

removing outlying samples;

decimation;

low-pass;

EWMA;

finite or infinite impulse response; or frequency domain filtering.

6. The method of claim 1, wherein the rotatum minimum of the conventional pump is the lowest rotatum with respect to the horsehead position in the rotatum array.

7. The method of claim 1, wherein the highest rotatum minimum of the non-conventional pump will be in the upper half of the horsehead down stroke.

8. The method of claim 1, wherein for a conventional pump determining the pump fillage includes determining if a well in which the pump is operating is a low producing well.

9. The method of claim 8, wherein the well is determined to be a low producing well if:

a determined pumpfill trend from one stroke to the next is decreasing consistently and trending in a way that suggests a true pumpfill will drop below 50%; and a peak torque of the prime mover occurs in the upper half of the down stroke; and the determined pump fill appears to be greater than 50%.

10. The method of claim 9, wherein if the well is determined to be a low producing well the microprocessor modifies the rotatum array to more precisely indicate the rotatum minimum.

11. The method of claim 10, wherein modifying the rotatum array includes determining a horsehead minimum position, a horsehead maximum position, a rotatum maximum and a rotatum minimum of the filtered array and dragging each of the determined positions to a rotatum zero line thereby producing a modified rotatum arry.

12. The method of claim 11, wherein determining the pump fillage includes scanning, by the microprocessor, the modified rotatum array from a lowest horsehead position to a highest horsehead position to determine a first rotatum minimum of the modified rotatum array; and determining, by the microprocessor, the pump fillage using the horsehead position associated with first rotatum minimum.

13. The method of claim 1, where the recording, storing, creating, determining and adjusting are initiated by an algorithm stored in the non-transitory memory and configured to be executed by the microprocessor.

14. A method for determining an optimal speed for a sucker rod pump comprising:

recording at regular intervals during a down stroke portion of an entire pump stroke, a raw torque value of a mechanical linkage of the rod pump with respect to a particular position of a horsehead of the rod pump at each recording interval;

storing, in a non-transitory memory associated with a microprocessor, the recorded raw torque with respect to the particular position of the horsehead as a raw torque array;

creating, by the processor, from the raw torque array a filtered torque array and storing the filtered torque array in the memory;

creating, by the processor, from the filtered torque array a rotatum array and storing the rotatum array in the memory;

determining, by the processor, a pump fillage of the rod pump from the rotatum array, and;

adjusting, by the processor, a speed of a prime mover based on the determined pump fillage, the speed being adjusted no more than every other complete stroke by increasing the speed of the prime mover if the determined pump fill is less than a predetermined level or decreasing the speed of the prime mover if the determined pump fill is more than the predetermined level, the speed being increased or decreased, by no more than a predetermined amount of the previous speed, based on the difference between the currently determined pump fill and the previous pump fill.

15. A method for determining an optimal speed for a sucker rod pump comprising:

recording at regular intervals during a down stroke portion of an entire pump stroke, a raw torque value of a mechanical linkage of the rod pump with respect to a particular position of a horsehead of the rod pump at each recording interval;

storing, in a non-transitory memory associated with a microprocessor, the recorded raw torque with respect to the particular position of the horsehead as a raw torque array;

creating, by the processor, from the raw torque array a filtered torque array and storing the filtered torque array in the memory;

creating, by the processor, from the filtered torque array a rotatum array and storing the rotatum array in the memory, wherein a sample spacing value used to determine the rotatum array is selected from values between a minimum sample spacing producing a detectable difference in torque value between samples at the point when a piston of the sucker rod pump encounters a well bore fluid, and a maximum sample spacing such that there will not be a greater difference in torque than could be caused by things other than the piston of the sucker rod pump encountering the well bore fluid;

determining, by the processor, a pump fillage of the rod pump from the rotatum array, and;

adjusting, by the processor, a speed of a prime mover based on the determined pump fillage.

16. The method of claim 15, wherein the spacing between samples is a full integer value.

17. The method of claim 15, wherein the spacing between samples is a non-integer value.

18. The method of claim 17, wherein the non-integer sample is determined by, applying a weighting to the minimum sample and the maximum sample.

19. The method of claim 18, wherein the weighting applied to the minimum and maximum samples is equal to 100% of the selected sample spacing.

* * * * *